US006250393B1

(12) United States Patent
Mackenzie et al.

(10) Patent No.: US 6,250,393 B1
(45) Date of Patent: Jun. 26, 2001

(54) BOTTOM HOLE ASSEMBLY WITH COILED TUBING INSERT

(75) Inventors: Gordon Mackenzie, Aberdeen (GB); Darrin F. Willauer, The Woodlands; Martin P. Coronado, Cypress, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/175,013

(22) Filed: Oct. 19, 1998

(51) Int. Cl.[7] ..... E21B 19/16
(52) U.S. Cl. ..... 166/380; 166/242.7
(58) Field of Search ..... 166/377, 242.6, 166/242.7, 242.2, 380, 325

(56) References Cited

U.S. PATENT DOCUMENTS

| | | | | |
|---|---|---|---|---|
| Re. 36,723 | * | 6/2000 | Moore et al. | 166/242.2 |
| 4,759,406 | * | 7/1988 | Smith et al. | 166/65.1 |
| 4,828,037 | | 5/1989 | Lindsay et al. . | |
| 4,846,281 | | 7/1989 | Clary et al. . | |
| 5,238,273 | | 8/1993 | Laflin et al. . | |
| 5,251,695 | | 10/1993 | Coronado . | |
| 5,285,850 | | 2/1994 | Bayh, III . | |
| 5,306,050 | | 4/1994 | Laflin et al. . | |
| 5,452,923 | | 9/1995 | Smith . | |
| 5,524,937 | | 6/1996 | Sides, III et al. . | |
| 5,671,811 | | 9/1997 | Head . | |
| 5,704,393 | * | 1/1998 | Connell et al. | 137/614.21 |
| 5,718,291 | * | 2/1998 | Lorgen et al. | 166/377 |

FOREIGN PATENT DOCUMENTS

| | | |
|---|---|---|
| 0 612 913 A1 | 2/1994 | (EP) . |
| 0 681 085 A2 | 5/1995 | (EP) . |

* cited by examiner

*Primary Examiner*—David Bagnell
*Assistant Examiner*—Zakiya Walker
(74) *Attorney, Agent, or Firm*—Madan, Mossman & Sriram, P.C.

(57) ABSTRACT

An Internal Bottom Hole Assembly (IBHA) for a Coiled Tubing (CT) enables the CT to be used with other devices downhole. The IBHA includes a connector, a valve assembly and an emergency disconnect device, all of which are mounted internally in the CT. The connector couples to the inside of the CT by means of wedges that are urged against the inside wall of the CT. The valve assembly may be mounted either between the connector and the disconnect device or may be on the side of the connector away from the disconnect device. The valve assembly includes one or more flapper valves that are able to pass a ball through at a minimum flow rate of fluid, enabling the ball to be used to operate the disconnect device.

22 Claims, 3 Drawing Sheets

BOTTOM HOLE ASSEMBLY WITH COILED TUBING INSERT

BACKGROUND OF THE INVENTION

1. Field of the Invention

This invention relates generally to an internal connector for use with coiled tubing connector and a method by which coiled tubing is secured to the top of a downhole tool string used in the drilling and servicing of oil and gas wells.

2. Background of the Art

Increasingly, the drilling of oil and gas wells is done with boreholes that are deviated from the vertical. While such deviated drilling can be performed using a drillstring comprising sections of jointed drill pipe, in many instances, the drilling is performed by using a coiled tubing (CT) that conveys mud to a downhole drilling motor that drives a drillbit for the actual drilling. CTs are also used in subsequent logging and servicing of the borehole.

Tools so far developed for connecting and disconnecting the CT, which is not threaded, to downhole motors and tool strings suffer from many disadvantages, including poor resistance to rotation, inadequate strength, poor serviceability and general unreliability. U.S. Pat. No. 5452923 discloses a CT connector for addressing some of these problems. The device disclosed in the '923 patent uses two tubular housings coupled together with a slip to anchor the CT and provide means for transmitting torque.

Typically, several thousand feet of tubing is coiled onto a large reel. The reel is mounted on a truck or skid. A CT injector head is mounted axially above the wellhead and the CT is fed to the injector for insertion into the well. The CT is plastically deformed as it is payed out from the reel and over a gooseneck guide which positions the CT along the axis of the wellbore and the injector drive mechanism.

Tools used with CT for production typically include one or more packer elements that act to isolate certain portions of the wellbore from each other. Such tools may be of any length but, for instance, for treatment of a particular interval in the wellbore, the tool must incorporate packer elements that, when positioned in the wellbore, effectively straddle and isolate that portion of the wellbore from the remaining portions, both above and below the zone of interest. Adding to the length of the tool string is the length of a coupling device for connecting the tool string to the CT. The coupling device, in addition to coupling the tool to the CT, also must be able to transmit torque, be detachable, and have valves therein to be able to close off any back-pressure from the well. These tools cannot be plastically deformed to pass around the reel or the gooseneck. In order to overcome this difficulty, it has been common prior practice to mount the tool in what is effectively an extension of the well casing above the wellhead and positioning the injector drive mechanism on top of this pressurized cylindrical enclosure.

Where the extra height above the wellhead is not available, the tool string is made up with a wireline lubricator and inserted into the borehole. During this insertion process, care has to be taken to maintain a pressure seal and avoid a blow-out. The wireline connector is replaced with the CT inserted from a suitable injection device. This extra step is time consuming and also has safety problems associated with it.

SUMMARY OF THE INVENTION

The present invention is an internal CT bottom hole assembly (IBHA) developed for applications where the CT is too large to use a conventional connector that attaches to the outside of the CT. It is also designed to eliminate, in some applications, the need for deploying the tool string by a pressure device conveyed on a wireline. Conventional connectors (either slip- or set screw-type), attached to the outside of the CT, may be larger than the tool string components being run. This can be a problem when running the tool string through small restrictions in the production tubing.

Since the IBHA fits inside the CT, there is no increase in diameter beyond that of the CT. This allows many operations to be completed with larger CT strings than would have been possible in the past. This is important in applications requiring maximum CT flow rate (e.g., acidizing) or tensile capacities (e.g. fishing) being done through tubing.

The IBHA includes a back pressure valve and a disconnect device. Having these two devices internal to the CT reduces the overall tool length requirements for inserting the CT into the borehole by 3–4'. This reduction in overall tool length is sufficient in many applications to eliminate the need for wireline pressure deployment of the tool string.

BRIEF DESCRIPTION OF THE DRAWINGS

For a detailed understanding of the present invention, reference should be made to the following detailed description of the preferred embodiment, taken in conjunction with the accompanying drawings, in which like elements have been given like numerals, wherein.

DETAILED DESERTION OF PREFERRED EMBODIMENTS

The various concepts of the present invention will be described in reference to FIGS. 1–3, which show schematic illustrations of embodiments of the device of the present invention.

Figure 1:
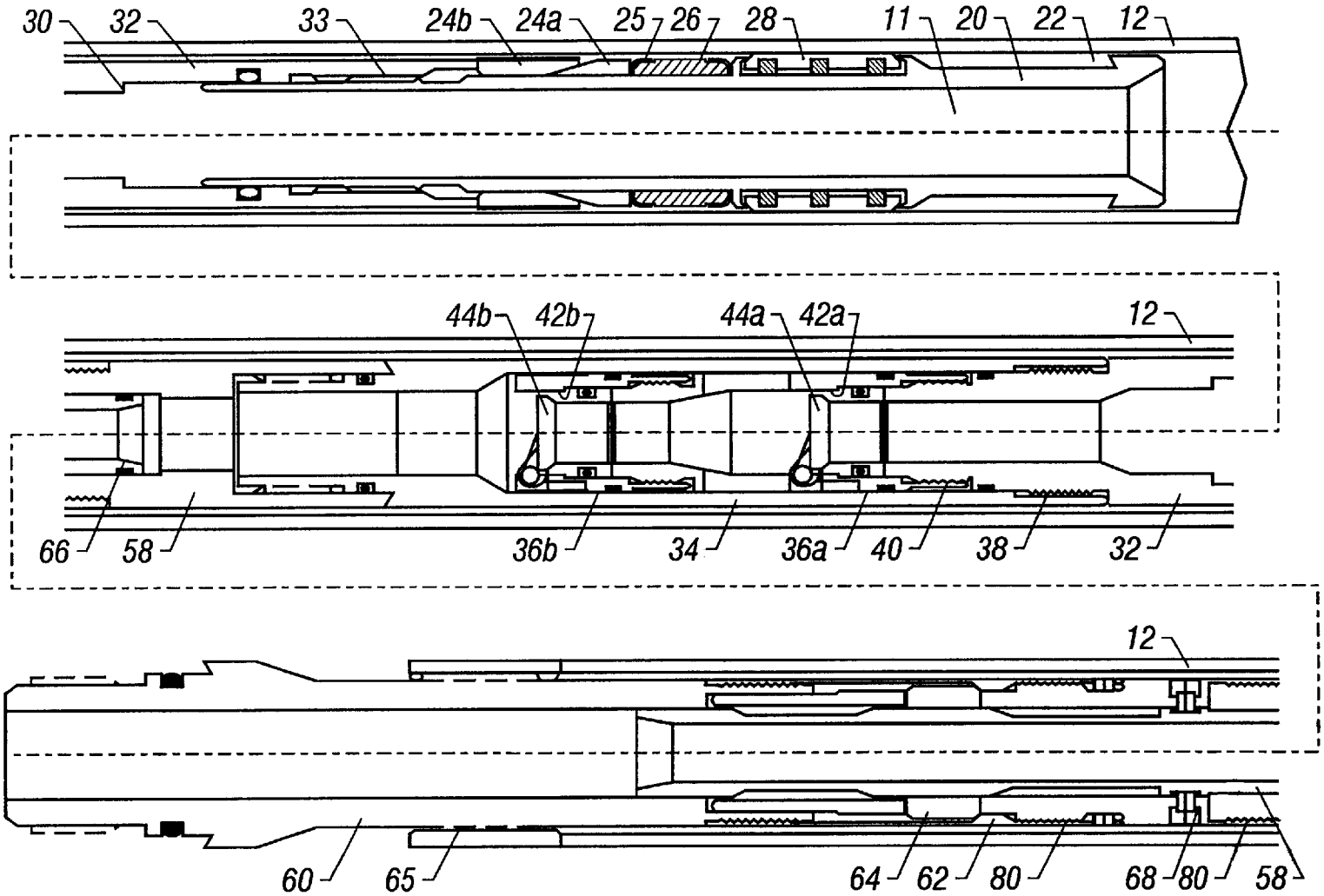
FIG. 1 shows a schematic illustration of an Internal Bottom Hole Assembly (IBHA) inserted into the CT

FIG. 1 shows an internal bottom hole assembly (IBHA) 10 inside a CT 12. The top portion of the IBRA, generally shown on the left side of FIG. 1 includes an internal CT connector having two principal parts: an upper, generally tubular portion 20 with its bottom end inserted into a lower, generally tubular portion 32. The upper portion 20 and the lower portion 32 of the CT connector are provided with an axial bore 11 there through for passing fluid. The upper portion 20 of the CT connector is adapted to be inserted into the CT 12 and has on its outside, drag blocks 28, a sealing element 26, and a wedgeshaped element 24*a* that, together with a like portion 24*b* on the lower portion 32 of the CT connector, forms a slip assembly. The drag blocks provide rotational resistance to the top portion when the bottom portion is rotated. This allows the thread 33 between the upper portion 20 and the lower portion 32 to be made up and set the slip. In the "disengaged" position shown in FIG. 1, there is a gap 25 between the inside of CT 12 and the outside of the sealing element 26 and the wedge 24*b*.

The upper CT connector portion 20 is also provided with a fishing neck 22 to facilitate fishing operations if the IBHA and the tool string are left downhole by removal of the CT 12. The lower portion 32 of the CT connector is provided with a stop 30, the function of which is discussed with reference to FIG. 2. The separation of the IBHA 10 and tool string from the CT 12 are accomplished by reversing the steps involved in connecting the CT 12 to the IBHA 10.

Figure 2:
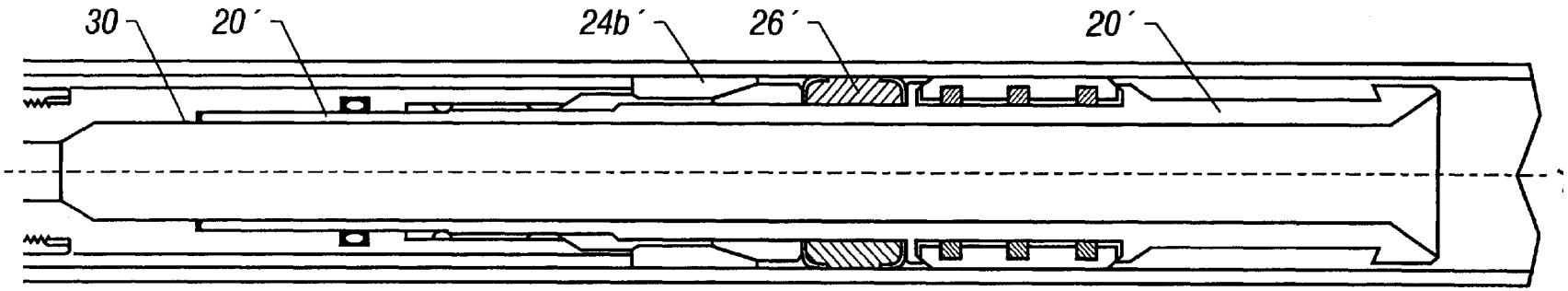
FIG. 2 shows the BHA of FIG. 1 when the internal connector is engaged to the CT.

The upper portion of the CT assembly (left illustration in FIG. 1) is shown in FIG. 2 when the connector is in the "engaged" position. The top portion 20 remains stationary while the bottom portion is rotated to set seal and slip. Once set, the stop 30 is rotated upward to contact the connector 20. The wedge 24*b* moves to the position indicated by 24*b*' and engages the inside of the CT 12. At the same time, the seal 26 is forced into the position 26' to form an effective fluid seal. The gap 25 between the inside of CT 12 and the outside of the sealing element 26 and the wedge 24*b* is closed. Those versed in the art would recognize that other arrangements of wedges could be used for the purpose of engaging the connector to the inside of the CT, e.g., two spaced apart wedges on either the connector or the CT and a third wedge on the other of the connector and the CT, the third wedge being interposed between the first two wedges.

Returning to FIG. 1, in the center portion is shown the back pressure valve section of the IBHA. This is included in the IBHA as a safety precaution to prevent fluid flow up the tubing. This is specially important when running CT where a hole in the tubing at the surface would allow the well to flow uncontrollably. It includes a tubular member 34 inside the CT 12 provided with internal threads 38, for engaging corresponding threads on the outside of the bottom part 32 of the CT connector. Inside the tubular member 34 are a pair of valves coops 36*a*, 36*b* having valve seats 42*a*, 42*b* and flappers 44*a*, 44*b* respectively. The operation of the valves would be familiar to those versed in prior art. Normally, the flappers 44*a*, 44*b* are maintained in a closed position by spring loading. Pressure of the CT fluid forces the flappers 44*a*, 44*b* away from the respective valve seats 42*a*, 42*b* and allows the fluid to flow through. Any increase in the fluid pressure below the valve assembly moves the flappers 44*a*, 44*b* to the position shown in FIG. 1 and closes off the valves, preventing any backflow of fluid from the borehole. The flapper is designed so that a ball can be pumped through it at a minimum flow rate, the function of the ball is further described below in connection with the operation of the hydraulic disconnect portion of the assembly.

An alternate embodiment of the invention has only a single flapper back pressure valve. This may be used when the redundancy of a second flapper is not required.

Those versed in the art would recognize that other kinds of valves, such as a ball check valve or poppet valve, could also be used to prevent a buildup of backpressure in the CT. Such injection control valves are known in prior art.

Below the back pressure valve section is an emergency disconnect section. In one embodiment of the invention, this is hydraulically operated. This emergency disconnect section couples the bottom hole assembly to a downhole device (not shown) external to the CT, such as tool strings, for use in the borehole. The hydraulic disconnect portion of the device comprises two main parts. The upper portion 58 generally extends from the bottom of the center illustration of FIG. 1 into the top of the right illustration of FIG. 1. The bottom portion of the disconnect 60 generally encompasses the lower portion of the right illustration of FIG. 1. and is connected by a threaded tool point to the tool string or other downhole device (not shown).

The hydraulic disconnect is a ball-operated device that requires tubing pressure for activation. When a ball is pumped through the upper portion of the assembly and seated on the ball seat 66, this allows a buildup of pressure in the CT. This pressure buildup shears the shear screw 68 between the union 80 and the upper portion 58 and allows the top section of the disconnect to unlatch from the bottom section. The tool is latched together by dogs 64, retraction of which unlatches the top section of the disconnect from the bottom section. The use of dogs 64 contributes to an increase in the tensile strength of the device, compared to prior art 15 devices that rely on a collet mechanism. The tool is rotationally locked by using an octagonal anti-rotating spline 65.

The torsional strength of this design is advantageous in underreaming and cutting operations where cyclic torsional loading is encountered. Due to the rotational locking, the disconnect can be used in conjunction with mud motors.

Operation of the hydraulic disconnect effectively separates the coil tubing and the upper portion of the CT assembly, from the downhole tool string or other devices. Once the hydraulic disconnect has been operated, an internal fishing neck 62 on the lower portion of the disconnect is exposed. This fishing neck can be used for subsequent retrieval of the tool string below the hydraulic disconnect device.

Those versed in the art would recognize that a mechanical or electrical disconnect device could be used instead of the hydraulic device disclosed above. Such disconnect mechanisms are known in prior art.

Figure 3:
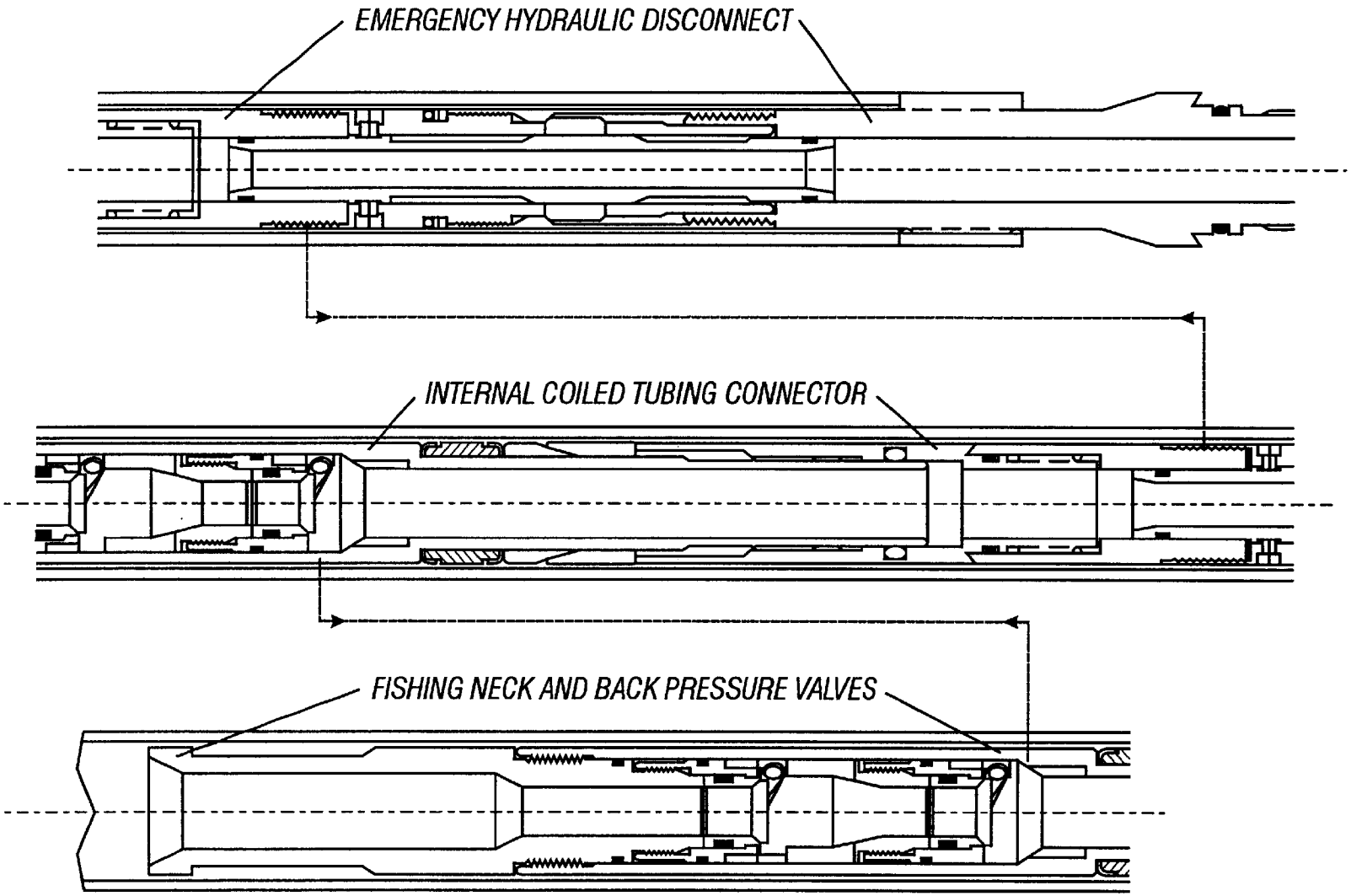
FIG. 3 is a schematic illustration of an alternate BHA having an internal CT insert.

FIG. 3 shows an alternate configuration of the main components of the assembly. In this arrangement, the fishing neck and back pressure valves are located at the top of the assembly, the internal CT connector is located below the back pressure valves and the hydraulic disconnect is positioned below the internal CT connector. Such an arrangement would perform substantially the same function in substantially the same manner to give substantially the same result as the device illustrated in FIG. 1.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. An internal bottom hole assembly (IBHA) connected within coiled tubing, the assembly comprising:

(a) a first connector for coupling the IBHA to an inside surface of the coiled tubing (CT); and, (b) a check valve assembly disposed inside of the CT and secured at one end thereof to the inside surface of the CT by said first connector, an opposite end of the check valve assembly having a downhole device connector, said check valve assembly being oriented for preventing backflow of fluid from a connected downhole device into the CT.

2. The IBHA of claim 1 further comprising a disconnect device for disposition inside of the CT, said disconnect device having first and second end connections, said first end connection being secured to the opposite end of the check valve assembly and the second end connection being secured the downhole device connector.

3. The IBHA of claim 2 wherein the disconnect device is selected from the group consisting of: (i) a hydraulic disconnect, (ii) a mechanical disconnect, and (iii) an electrical disconnect.

4. The IBHA of claim 3 wherein the disconnect device further comprises a neck to facilitate removal of a lower portion of the IBHA and the downhole device from the borehole.

5. The IBHA of claim 1 wherein the first connector further comprises first and second portions each including a wedge, the first portion being adapted to move relative to the second portion and thereby urge the wedge on the second portion against the CT inside surface.

6. The IBHA of claim 5 wherein the first portion of the first connector includes a seal adapted to be urged against the CT inside surface upon relative upon motion of the first and second portions of the first connector.

7. The IBHA of claim 5 wherein the first portion of the first connector further comprises a neck to facilitate removal of the IBHA from the borehole.

8. The IBHA of claim 1 wherein said check valve is selected from the group consisting of: (i) a flapper valve, (ii) a ball valve, (iii) a ball check valve, and (iv) a poppet valve.

9. The IBHA of claim 1 wherein the first connector is adapted to releasably connect the IBHA to the CT.

10. An internal bottom hole assembly (IBHA) connected within coiled tubing, the assembly comprising:

(a) a first connector for coupling the IBHA to an inside of the coiled tubing (CT); and (b) an emergency disconnect device disposed inside of the CT and secured at one end thereof to the inside surface of the CT by said first connector, an opposite end of the disconnected device having a downhole device connector.

11. The IBHA of claim 10 further comprising a check valve assembly for preventing the backflow of fluid from the downhole device to the CT, said valve assembly being at a location selected from: (i) between the first connector and the disconnect device, and (ii) on a side of the first connector away from the disconnect device.

12. The IBHA of claim 11 wherein said check valve is selected from the group consisting of: (i) a flapper valve, (ii) a ball valve, (iii) a ball check valve and (iv) a poppet valve.

13. The IBHA of claim 11 wherein the disconnect device is selected from the group consisting of: (i) a hydraulic disconnect, (ii) a mechanical disconnect, and (iii) an electrical disconnect.

14. The IBHA of claim 13 wherein the disconnect device further comprises a neck to facilitate removal of a lower portion of the IBHA and the downhole device from the borehole.

15. The IBHA of claim 10 wherein the first connector further comprises first and second portions each including a wedge, the first portion being adapted to move relative to the second portion and thereby urge the wedge on the second portion against the inside surface of the CT.

16. The IBHA of claim 15 wherein the first portion of the first connector includes a seal adapted to be urged against the CT inside surface upon relative motion of the first and second portions of the first connector.

17. The IBHA of claim 15 wherein the first portion of the first connector further comprises a neck to facilitate removal of the IBHA from the borehole.

18. The IBHA of claim 10 wherein the first connector is adapted to releasably connect the IBHA to the CT.

19. A method of using a coiled tubing (CT) with a downhole device for operations in a borehole, the method comprising:

(a) inserting an internal bottom hole assembly (IBHA) inside an end of the CT;

(b) using a connector on the IBHA to couple the IBHA to the inside of the CT; and (c) providing an emergency disconnect device on the IBHA disposed inside of the CT for coupling the CT to the downhole device.

20. The method of claim 19 further comprising using a valve assembly on the IBHA to prevent backflow of fluid from the downhole device to the CT, said valve assembly being connected to the connector at a position selected from (i) between the connector and the disconnect device, and (ii) to the connector on a side away from the disconnect device.

21. A method of using a coiled tubing (CT) with a downhole device for operations in a borehole, the method comprising:

(a) inserting an internal bottom hole assembly (IBHA) inside an end of the CT;

(b) using a connector on the IBHA within the inside of the CT to couple the IBHA to an inside surface of the CT; and (c) using a valve assembly that is on the IBHA, within the inside of the CT, and operatively coupled to a downhole device to prevent backflow of fluid from the downhole device to the CT.

22. The method of claim 21 further comprising the use of an emergency disconnect device on the IBHA within the inside of the CT for coupling the downhole device to the valve assembly.

* * * * *